United States Patent [19]

Walters

[11] 4,344,450

[45] Aug. 17, 1982

[54] ICING PREVENTOR

[76] Inventor: William R. Walters, 910 W. Caddo, Cleveland, Okla. 74020

[21] Appl. No.: 138,584

[22] Filed: Apr. 8, 1980

[51] Int. Cl.[3] ..... E03B 7/12

[52] U.S. Cl. ..... 137/62; 236/99 R; 237/80; 60/531

[58] Field of Search ..... 137/59, 62; 60/530, 60/531; 236/99 R; 237/80; 251/11

[56] References Cited

U.S. PATENT DOCUMENTS

| | | | |
|---|---|---|---|
| 1,268,648 | 6/1918 | Van Meter | 137/62 |
| 1,567,081 | 12/1925 | Robertshaw | 251/11 |
| 2,097,585 | 11/1937 | Carson | 251/11 |
| 2,214,272 | 9/1940 | Dillman | 251/11 |
| 2,938,384 | 5/1960 | Soreng et al. | 236/99 R |
| 2,960,303 | 11/1960 | Smallpiece | 251/11 |
| 3,369,556 | 2/1968 | Allderdice | 137/62 |
| 3,593,917 | 7/1971 | Buisson | 236/99 R |
| 4,016,804 | 4/1977 | Turecek | 236/99 R |
| 4,066,090 | 1/1978 | Nakajima et al. | 137/62 |
| 4,205,698 | 6/1980 | Hucks | 137/62 |
| 4,214,698 | 7/1980 | Josefsson | 236/99 R |

*Primary Examiner*—George L. Walton
*Attorney, Agent, or Firm*—Head & Johnson

[57] ABSTRACT

Apparatus for connection to an outdoor water line carrying water at a selected pressure, for producing a selected low flow rate of water from the water line when the outdoor temperature drops below a selected temperature, which comprises an orifice in the end of the water line of selected small diameter, a closed chamber means having an expansible portion, filled with a selected condensible gas, for which the vapor pressure varies with temperature in a known manner, and closure means positioned adjacent the orifice and means connecting the expansible portion of the chamber to the closure means to shut off the flow of water when the temperature is above a selected value, and to open the orifice to a small trickle flow of water, whenever the temperature outdoors is less than a selected value, such as the freezing point of water.

3 Claims, 3 Drawing Figures

ICING PREVENTOR

BACKGROUND OF THE INVENTION

1. Field of the Invention

This invention lies in the field of water control valves. More particularly, it is connected with a temperature sensitive valve which will stop the flow of water from a water line when the outdoor temperature is above a certain selected temperature, and will start the flow of water when the outdoor temperature is below a certain selected temperature.

2. Description of the Prior Art

In the prior art fairly complicated and expensive means have been provided, involving in many cases, electrically sensitive temperature sensing means controlling electro-magnetic valves, so that when the outdoor temperature becomes less than a selected value, in the neighborhood of 32° F., then the valve will open and allow a small trickle of water to flow through the outdoor water line, the motion of the water being sufficient to prevent the freezing of the water in the water line exposed to the cold outdoor temperature. Because of the expense and complications of these various devices their use is limited and recourse is had to permitting the water to flow through the outdoor water line to be continuous throughout the time that the line is unattended, rather than to permit the flow only when the temperature is below the selected value.

SUMMARY OF THE INVENTION

It is a primary object of this invention to provide a simple mechanical device sensitive to the atmospheric temperature surrounding the device, to close off the flow of water from an outdoor water pipe when the outdoor temperature is higher than a selected temperature, and to open a small orifice in that line whenever the temperature drops below that selected temperature.

It is a further object of this invention to provide such an apparatus that is simple, inexpensive, and can operate unattended without difficulty over an extended period of time.

These and other objects are realized and the limitations of the prior art are overcome in this invention by providing a small orifice of selected diameter in the end of the water line, which is outdoors, and is exposed to the outdoor temperature during the season of the year when the temperatures may drop below freezing. There is a closure means adjacent to the orifice that can be pressed against the orifice, with a selected force, which will shut off the flow of the trickle of water which is otherwise possible through the small orifice.

Motive power for pressing the closure means against the orifice is derived from a thermally sensitive expansion chamber which contains a selected amount of a selected condensible gas, for which the vapor pressure as a function of temperature is well known. The container or chamber is made expansible so that as the vapor pressure increases inside of the chamber, the expansion increases, and the expansible part moves outwardly and presses on the closure means, thus pressing the closure means against the orifice with a force sufficient to stop the flow of water.

Spring means are provided for restraining the movement of the closure means so that only the force exerted by the expansible portion of the chamber exceeds the force compressing the spring will the closure means close off the orifice and stop the flow.

The temperature at which the force exerted by the expansible portion of the chamber exceeds the spring force can be adjusted by changing the spring constant, and thus the combined operation can be set for any selected temperature, such as a temperature in vicinity of the freezing point of water. In this way when the atmospheric temperature reaches that freezing point the vapor pressure of the gas in the chamber will be reduced to the point where the spring will press the closure means away from the orifice, whereby the force on the closure means exerted by the water pressure through the small area of the orifice will force the closure means away from the orifice, and thus permit flow of water through the orifice to a drain. Thus a small trickle of water flow through the entire water line will be maintained so long as the temperature remains below the selected temperature.

BRIEF DESCRIPTION OF THE DRAWINGS

These and other objects and advantages of this invention and a better understanding of the principles and details of the invention will be evident from the following description taken in conjunction with the appended drawings, in which.

DETAILED DESCRIPTION OF THE PREFERRED EMBODIMENT

Figure 1:
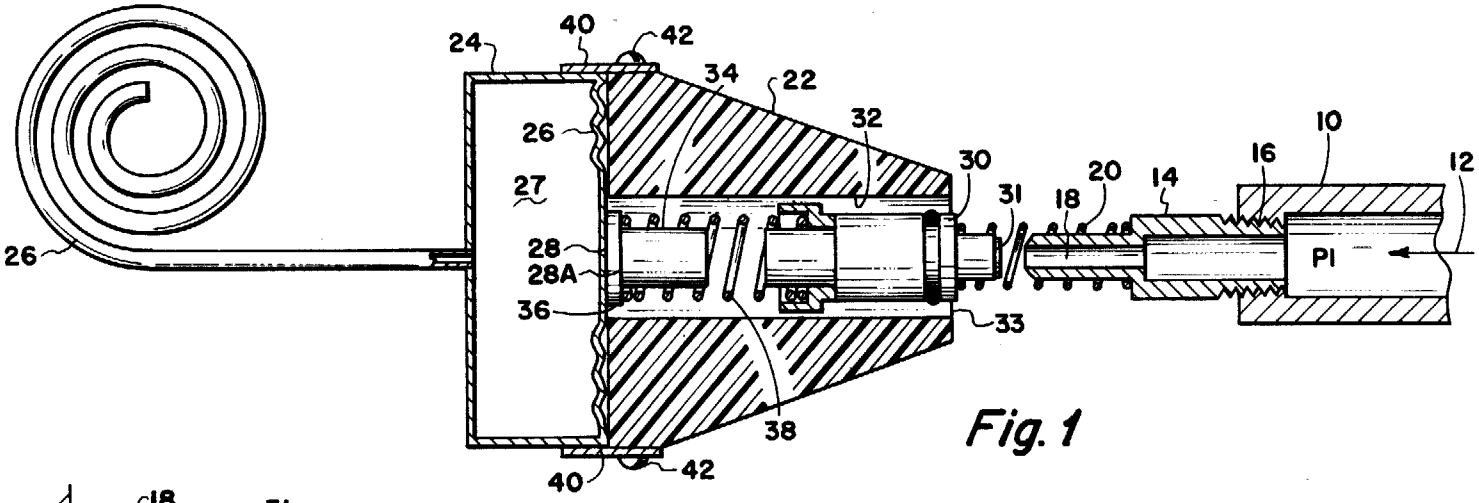
FIG. 1 is a schematic diagram of the invention.

Referring now to the drawing and in particular to FIG. 1 there is shown a schematic diagram of one embodiment of the apparatus of this invention.

In many fields of industry there are types of operations which involve the use of water and water carrying pipes which are exposed to atmospheric temperature which at times may drop below the freezing point. So long as there is flow of water through the pipes in the course of utilization of the water, the problem of freezing is, of course, not important. But during the hours that the operations are shut down, if the temperature in the area adjacent the pipes gets below freezing there is danger that the water may freeze in one or more positions of the pipes, with consequent difficulties, such as burst pipes, or the need to thaw the pipes, and so on.

In such circumstances it may be necessary to leave a trickle of water running through the pipes throughout the night hours when operations are stopped and the lowest temperatures occur, to prevent this freezing of water in the pipes. This is a very wasteful type of solution for the problem, since the anticipated low temperature may not occur, and therefore the loss of water resulting from the flow through the pipes is a sizeable waste of resource and money.

This device will be described in connection with FIG. 1, and is a simple automatic mechanical, nonmanual, type of apparatus which continuously monitors the environmental temperature, which would be in the vicinity of the freezing point of water, the flow of water through the pipe is shut off. However, if at any time the temperature in the vicinity of the pipe is below that selected temperature, then the device permits a small orifice in the water line to be uncovered, and to permit the flow of water through this orifice at a selected low flow rate, which would be considered adequate to maintain a condition for which the water in the water line would not freeze.

Figure 3:
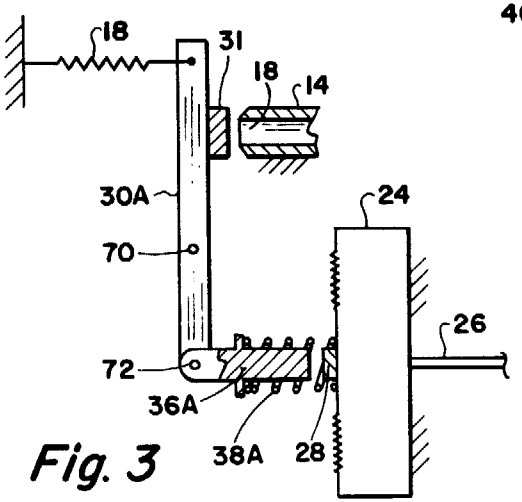
FIG. 3 is a schematic diagram of a second embodiment.

In FIG. 1 the numeral 10 illustrates a portion of the outdoor water line. In the end of that water line 10 is threaded 16 an orifice unit 14 which has a necked portion containing an orifice of selected small diameter 18. Adjacent to the orifice 18 is a closure means 30, which carries a closure pad 31 of resilient material on its end. The closure means can be coaxial, as shown, and is adapted to be moved longitudinally or axially against the orifice to close off the flow through the orifice 18. Of course, other arrangements of closure means can be used, such as is illustrated in FIG. 3.

A body 22 of the device is provided, to which is attached by straps 40, and screws 42, a motor, or operating element 24, which comprises a closed chamber, which may be circular, and in the form of a shallow pan, covered with a flexible diaphragm 26. There is an axial small tube of considerable length attached to the chamber through which the space 27 inside the chamber can be filled with a selected condensible gas, the vapor pressure of which as a function of temperature is known.

There are many such condensible gases available on the market each of which have different boiling points and thus different vapor pressures at selected temperatures. One of these can be selected such that the vapor pressure inside of the chamber in space 27 pressing outwardly on the flexible diaphragm 28 will be able to exert a force on the member to 36, 34 to press, by means of a helical spring 38, onto the closure means 30, to press it against the orifice 18.

Depending on the pressure P1 inside of the pipe 10 and dependent on the diameter of orifice 18 a certain selected force, which would be the product of the unit pressure in pounds per square inch for example times the area of the orifice, in square inches representing, a selected force F. When the vapor pressure pressing on the diaphragm 28 can exert a force G which is larger than the force F exerted on the closure means by the water pressure over the small area of the orifice then the diaphragm will move the closure means, with the complient means 31 and it will seal off the flow of water out through the orifice 18.

At any higher temperature the force exerted by the diaphragm will be still greater and therefore the closure means will be pressed even more tightly against the orifice. On the other hand, when the temperature drops, the force becomes less, and the design of the device can be such that when the outdoor temperature in the vicinity of the water line, and of this device, reaches a selected critical temperature, the force exerted by the chamber diaphragm will be less than the force exerted by the water pressure, and the closure means will be pushed away from the orifice, and water will flow through the orifice at a rate determined by the pressure inside of the pipe 19.

There is a small helical spring 20, of thin wire which is utilized simply to push the closure means away from the orifice and prevent oscillation when the pressure of the thermal motor 24 is insufficient to close off the orifice. On the other hand, when the pressure of the diaphragm becomes great enough, it can easily overcome the force of the spring 20 and close off the orifice.

There is also another helical spring 38, which surrounds the member 34 and a portion of the closure means 30. This is a rather stiff spring and is provided primarily to adjust for minor variations in spacing and sizes, of the several components which make up the distance between the normal position of the diaphragm 28 and the position of the orifice. The dashed line 28A indicates the possible position of the diaphragm at high temperature when the orifice is sealed.

The essential items of this system are an orifice 18 of selected small size, a water pipe 10 providing water under pressure P1 to that orifice, a closure means 30 having a closure tip 31 to press against the orifice, a thermal motor 24 which comprises a closed chamber with a flexible diaphragm having a condensible gas of a selected nature, that can exert, at a critical temperature, a force that will press the closure member tightly to the orifice to close off the flow and which will at temperatures lower than that critical temperature have a lesser force, which is unable to overcome the force due to the water pressure inside of the orifice, and thus flow will be permitted from the orifice. This flow will then take place through the full length of the pipe 10 so that freezing will be prevented throughout the length of the pipe.

Figure 2:
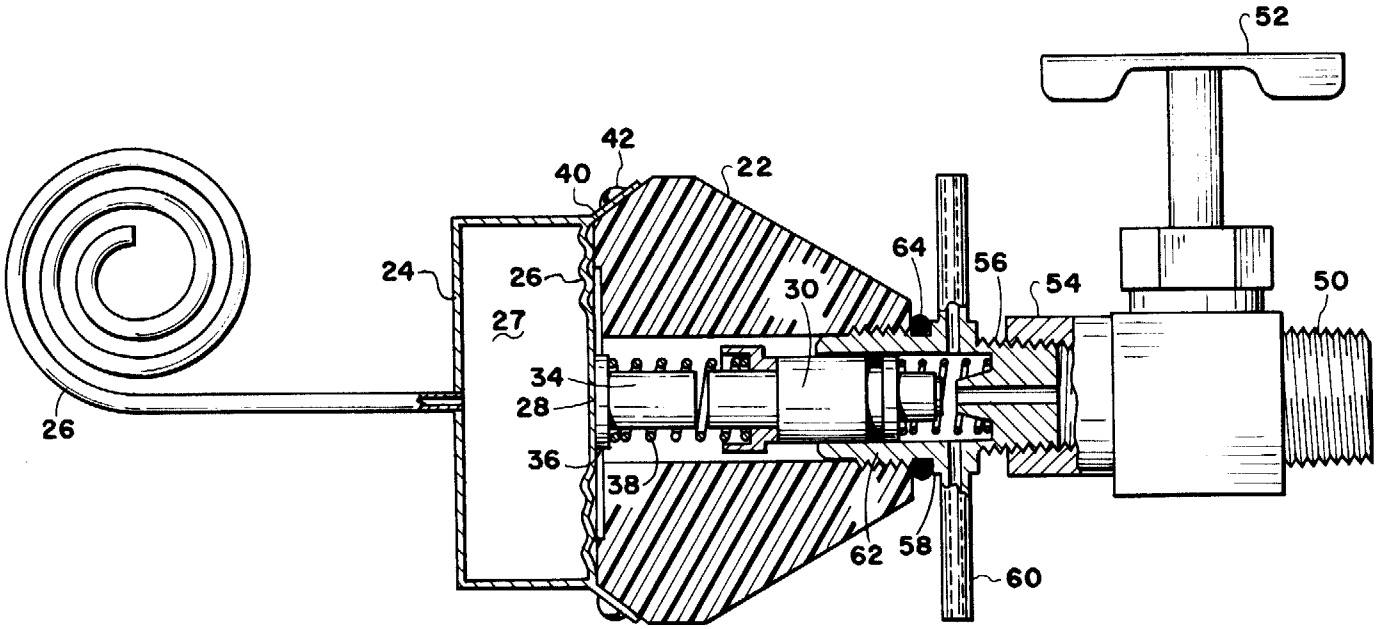
FIG. 2 is a view of one embodiment of the invention.

In FIG. 2 all of these essential items are shown plus a valve 52 which may conveniently be of the form of a needle valve, so that by adjusting that valve the rate of flow inside the orifice can be any selected value, thus altering the rate of flow of water from the orifice when it is opened.

The threaded portion 50 would correspond to the portion 14 of FIG. 1 and the portion 58 would be considered a housing around the portion of FIG. 1 between the end of the body 22 and the shoulder of the portion 14. This element 58 is provided as a housing to contain the water which flows through the orifice and is permitted to run out of one or the other of the two tubular members 60. O-ring means such as 64, and an O-ring 33 surrounding the member 30, seal water out of the body and retain it in the member 58, so that freezing up of the apparatus inside of the body 22 and in the vicinity of the thermal motor 24 can not take place.

Referring now to FIG. 3 there is shown another embodiment of the closure means, and the mechanism for operating the closure means by the thermal motor 24. Shown is a portion of the neck 14 and the orifice 18 with a closure pad 31 attached to a lever 30A which is pivoted at a pin 70. At the bottom end of the lever is a second pin 72, to which an actuator 36A corresponding to the device 36. There is a helical spring 38A corresponding to the spring 38 in FIG. 1, and the thermal motor 24, is fastened rigidly to a framework which also includes the neck 14.

As the temperature rises the pressure of the gas inside the chamber 24 increases, and moves the diaphragm 28 to the left, pressing through the spring 38 on the actuator 36A, which pushes the bottom end of the lever 34A to the left, and the top of the lever 34A to the right. This presses the closure pad 31 against the orifice 18.

When the temperature drops below the critical selected temperature, the reverse takes place the diaphragm moves to the right permitting the weak spring 18 to pull the closure or lever means, 30A, and the closure pad 31 away from the orifice permitting water to flow through the orifice 18.

It is seen therefore that there are other embodiments possible with this same principle by means of which a thermal motor continuously monitors the temperature, and at a selected critical temperature will arrange to open a closure means, over a small orifice, and to permit the selected flow rate of water to trickle through the water pipe, so as to prevent freezing inside of the pipe.

While the invention has been described with a certain degree of particularly, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. Apparatus for connection to an outdoor water line carrying water at a selected pressure, for producing a selected low flow rate of water from said water line, when the outdoor temperature drops below a selected temperature, comprising:

(a) a single orifice of selected small diameter in the end of said water line;

(b) body means comprising a closed chamber and a housing for a valve closure means, said closed chamber means having an expansible portion, said chamber means filled with a selected condensible gas for which the vapor pressure varies with temperature in a known manner;

(c) said closure means being positioned adjacent said single orifice, a portion of said closure means extending beyond and exteriorly of the housing in all positions of said closure means;

(d) means connecting said expansible portion of said chamber means to said closure means;

(e) said means connecting said expansible portion of said chamber to said closure means including series compliant means; and (f) helical spring means being positioned between said closure means and said orifice, said helical spring means surrounding said orifice and said exterior portion of said closure means;

whereby when the outdoor temperature is above a selected value, said expansible portion will move outwardly to press said exterior portion of said closure means against said orifice, to close off said flow; and when the outdoor temperature is below said selected value said expansible portion will move inwardly away from said exterior portion of said closure means permitting water flow through said orifice.

2. The apparatus as in claim 1 in which said expansible portion, said closure means and said orifice are collinearly arranged.

3. The apparatus as in claim 1 in which said series compliant means comprises helical spring means.

* * * * *